US006006675A

United States Patent [19]

Heil

[11] Patent Number: 6,006,675

[45] **Date of Patent: *Dec. 28, 1999**

[54] PALLET FOR STORING ITEMS WITH ALIGNED OR OFFSET WHEELS

[75] Inventor: Julius F. Heil, Sharpsburg, Ga.

[73] Assignee: Burnham Service Company, Inc., Atlanta, Ga.

[ * ] Notice: This patent is subject to a terminal disclaimer.

[21] Appl. No.: 09/075,632

[22] Filed: May 11, 1998

Related U.S. Application Data

[63] Continuation-in-part of application No. 08/857,528, May 16, 1997, Pat. No. 5,787,817.

[51] Int. Cl.[6] ..... B65D 19/44

[52] U.S. Cl. ..... 108/55.3; 108/53.3

[58] Field of Search ..... 108/51.11, 55.1, 108/55.3, 57.28; 206/386; 280/33.998, 32, 79, 11

[56] References Cited

U.S. PATENT DOCUMENTS

| | | | |
|---|---|---|---|
| 3,620,388 | 11/1971 | Mansson | 214/10.5 |
| 3,753,407 | 8/1973 | Tilseth | 108/53 |
| 3,833,138 | 9/1974 | Dean | 214/334 |
| 4,804,087 | 2/1989 | Smith | 206/335 |
| 4,911,084 | 3/1990 | Sato et al. | 108/51.1 |
| 5,170,721 | 12/1992 | Troth et al. | 108/51.1 |
| 5,445,396 | 8/1995 | Sebor | 108/53.3 |
| 5,505,140 | 4/1996 | Wittmann | 108/51.1 |

FOREIGN PATENT DOCUMENTS

| | | | |
|---|---|---|---|
| 0 785 144 | 7/1997 | European Pat. Off. . | |
| 2 106 986 | of 0000 | France . | |
| 2 446 239 | of 0000 | France . | |
| 239847 | 5/1982 | German Dem. Rep. . | |
| 204894 | 12/1983 | Germany | 206/386 |
| 64-9157 | 1/1989 | Japan . | |
| 9157 | 1/1989 | Japan | 206/386 |

OTHER PUBLICATIONS

*Nestable Plastic Pallets*, Litco Product Information brochure, 1991.

*AgBin Collapsible Containers for Agriculture*; Perstorp Xytec, Inc., product information brochure, 1995.

*Primary Examiner*—Peter M. Cuomo
*Assistant Examiner*—Gerald Anderson
*Attorney, Agent, or Firm*—Jones & Askew, LLP

[57] ABSTRACT

A pallet for a wheeled item comprises a base frame having openings for receiving forklift arms, a plurality of tracks mounted on the base frame for receiving the wheels of the item, and a plurality of ramps mounted on the base frame and sloping from the tracks toward the base frame so that when the wheeled item is shifted on the wheels from the tracks along the ramps, the undercarriage of the wheeled item comes to rest on the pallet. Wheeled items can be quickly loaded and secured on the pallet and can be manipulated with a forklift for storing wheeled items in stacked relation. The pallet can be designed to store wheeled items with aligned or offset casters.

23 Claims, 7 Drawing Sheets

PALLET FOR STORING ITEMS WITH ALIGNED OR OFFSET WHEELS

CROSS-REFERENCE TO RELATED APPLICATIONS

This invention is a continuation-in-part of U.S. patent Ser. No. 08/857,528 filed on May 16, 1997 now U.S. Pat. No. 5,787,817 and expressly incorporated herein by reference in its entirety.

TECHNICAL FIELD

This invention relates to pallets for storing goods, and particularly relates to the storage of items on wheels such as casters.

BACKGROUND OF THE INVENTION

Goods are often effectively and efficiently stored and transported in stacked configuration. Stacking goods maximizes the use of available storage and transportation space. In addition, it is desirable to manipulate such goods with a forklift for quick handling of the goods. This saves labor and time. Some goods, however, are difficult to store and transport in stacked configuration and are not easily manipulated with a forklift. Wheeled items such as photocopiers on casters are an example of such goods which are difficult to handle.

Typically, an item such as a photocopier on casters has to be placed on skids and secured to the skids to be manipulated with a forklift and stored and transported in stacked configuration. Normally, two laborers and a forklift are required to load and secure a photocopier to skids. The photocopier is secured to the skids by bolting the photocopier to the skids. This is a time consuming task which takes at least about 20 minutes per item.

Alternatively, wheeled items such as photocopiers on casters can be stored on an open floor without stacking the items. Without stacking, however, photocopiers occupy a large space. In addition, photocopiers, unsecured to skids, are difficult to manipulate with a forklift and are rolled about the floor instead. This requires a lot of labor and is time consuming.

Another problem with storing items such as photocopiers on an open floor is that photocopiers are controlled in inventory by serial number. When a specific serial number is requested, an employee must locate the unit within the bulk storage area and retrieve the particular photocopier by moving other photocopiers that obstruct its path. The desired unit is then pushed to the area in which it is to be processed. This is also undesirably time consuming.

Therefore, there is a need for a system for storing and transporting wheeled items such as photocopiers in a manner that allows stacking of the items and their manipulation with a forklift. There is also a need for a system for storing and transporting wheeled items with aligned and offset casters.

SUMMARY OF THE INVENTION

The present invention solves the above-described problems in the prior art by providing a pallet for a wheeled item comprising a plurality of tracks and a plurality of ramps mounted to a base frame having openings for receiving forklift arms. The plurality of tracks and plurality of ramps are structured and arranged so that when the item is shifted on the wheels from the plurality of tracks along the plurality of ramps, the undercarriage of the wheeled item comes to rest on a support surface of the pallet. With the undercarriage of the wheeled item resting on the pallet, rather than the wheels, the wheeled item can be secured to the pallet for storage and transportation. Therefore, the pallet of the present invention provides for swift loading of the wheeled item onto the pallet. The pallet allows the wheeled item to be manipulated with a forklift and stored and transported in a stacked configuration. Manipulation with a forklift reduces labor and time required for handling the wheeled item. In addition, stacking of the wheeled item provides for more effective and efficient use of storage and transportation space.

More particularly, the pallet of this invention is suitable for storing and transporting wheeled items comprising an undercarriage and wheels extending from the undercarriage. The pallet of this invention can accommodate wheeled items having aligned or offset casters. The pallet base frame desirably has openings for receiving forklift arms and extends along a longitudinal axis from a first end to a second end. The plurality of tracks are mounted on the base frame for receiving the wheels of the wheeled item. The plurality of tracks each extend from the first end toward the second end of the base frame substantially parallel to and spaced from one another. The plurality of ramps are also mounted to the base frame and slope from the plurality of tracks toward the base frame. Each of the plurality of tracks extend from the one end of the base frame to a distal end and the plurality of ramps extend from respective distal ends of the plurality of tracks without interrupting an adjacent one of the plurality of tracks. The plurality of ramps are directed so as not to interfere with the travel of casters of the wheeled item along the tracks. Depending on the configuration of the casters or wheels of the wheeled item, the plurality of ramps can extend longitudinally or diagonally from respective distal ends of the plurality of tracks with respect to the longitudinal axis of the base frame or can extend laterally from the plurality of tracks.

For wheeled items with aligned casters, the pallet desirably includes ramps which slope laterally or diagonally from the corresponding plurality of tracks. For storing wheeled items with offset casters, particularly significantly offset casters, the ramps of the pallet desirably extend longitudinally or diagonally from the respective distal ends of the plurality of tracks so that the offset casters do not interfere with adjacent tracks.

Desirably, the pallet of this invention includes a support adjacent the plurality of tracks extending from the pallet in a direction away from the base frame so that when the wheeled item is shifted on the wheels from the plurality of tracks along the plurality of ramps, the undercarriage of the wheeled item comes to rest on the support. In other words, the support extends upwardly from the pallet when the pallet is in loading position on a floor, and preferably, the support extends away from the base of the pallet beyond the plurality of tracks. Desirably, the plurality of ramps of the pallet are sloped toward the base frame relative to the support such that at least a portion of the weight of the wheeled item is shifted from the wheels of the item to the support when the wheeled item is shifted laterally on the wheels from the plurality of tracks, along the plurality of ramps, so that the undercarriage of the wheeled item comes to rest on the support.

According to a simplistic embodiment, the pallet of the present invention includes a base frame, a support mounted on the base frame and having a support surface for receiving the wheels of the item, and a plurality of ramps mounted on the base frame and sloping from proximate the support surface toward the base frame through recesses in the support. The support and the plurality of the ramps are structured and arranged so that when the wheeled item is shifted on the wheels from the support surface along the plurality of ramps, the undercarriage of the wheeled item comes to rest on the support surface.

According to a particular embodiment for a wheeled item having offset wheels, the pallet includes a first pair of tracks and a second pair of tracks spaced inwardly from the first set of tracks. Each of the first and second pairs of tracks extend from the one end of the base frame to a distal end and the plurality of ramps extend from respective distal ends of the first and second pairs of tracks without interrupting an adjacent one of the first and second pairs of tracks. Desirably, the plurality of ramps extend longitudinally or diagonally from respective distal ends of the plurality of tracks.

According to another embodiment particularly suitable for wheeled items with aligned casters, the tracks of the pallet include first and second tracks mounted on the base frame for receiving the wheels of the item to be stored and transported. The first and second tracks extend from the first end of the base frame toward the second end and are substantially parallel and spaced from one another. In addition, the ramps of the pallet include first and second ramps. The first ramp is mounted on the base frame of the pallet between the first and second tracks and slopes laterally with respect to the longitudinal axis of the base frame from the first track toward the base frame and second track. The second ramp is mounted to the base frame such that the second track is between the first and second ramps. The second ramp slopes laterally with respect to the longitudinal axis from the second track toward the base frame. Accordingly, when the wheeled item is shifted on the wheels laterally with respect to the longitudinal axis from the first and second tracks along the first and second ramps, the undercarriage of the wheeled item comes to rest on the pallet.

Still more particularly, the pallet of this embodiment for an item with aligned casters desirably includes first and second supports for receiving the undercarriage of the wheeled item when the wheeled item is shifted laterally down the first and second ramps. The first support extends from the pallet between the first and second tracks and in a direction away from the base frame. Likewise, the second support extends from the pallet in a direction away from the base frame adjacent the second track. The second support is positioned so that the second track is between the first support and the second support.

Desirably, the first and second supports extend away from the base frame of the pallet beyond the first and second tracks and extend from the first and second ramps, respectively. Particularly, the first and second supports suitably comprise a plurality of members spaced from one another between the first and second ends of the base frame and extend substantially perpendicular to the first and second tracks. The first and second ramps of the pallet of this embodiment are sloped toward the base frame relative to the first and second supports such that at least a portion of the weight of the wheeled item is shifted from the wheels of the item to the first and second supports when the wheeled item is shifted laterally on the wheels from the first and second tracks, along the first and second ramps, so that the undercarriage of the wheeled item comes to rest on the first and second supports. The pallet of the present invention is particularly suitable for wheeled items set on casters.

The pallets of the present invention can include first and second side walls extending between the first and second ends of the base frame along respective opposite sides of the base frame from to prevent the wheeled item from rolling laterally off the pallet. In addition, the pallet can include a plurality of pins for securing a strap for holding the wheeled item onto the pallet.

The pallets of the present invention can be made out of a variety of materials, but are desirably made out of polymer resin and, in particular, are preferably made by injection molding with polymer resin such as high density polyethylene.

Accordingly, an object of the present invention is to provide a system for storing and transporting wheeled items in a stacked configuration.

Another object of the present invention is to provide a system for handling wheeled items with a forklift.

Still another object of the present invention is to provide a system for more efficiently storing and transporting wheeled items.

Yet another object of the present invention is to provide a pallet for storing and transporting wheeled items.

A further object of the present invention is to provide a pallet for storing and transporting wheeled items with offset casters.

Other objects, features, and advantages of the present invention will become apparent from the following detailed description, drawings, and claims.

DETAILED DESCRIPTION OF DRAWINGS

Figure 3:
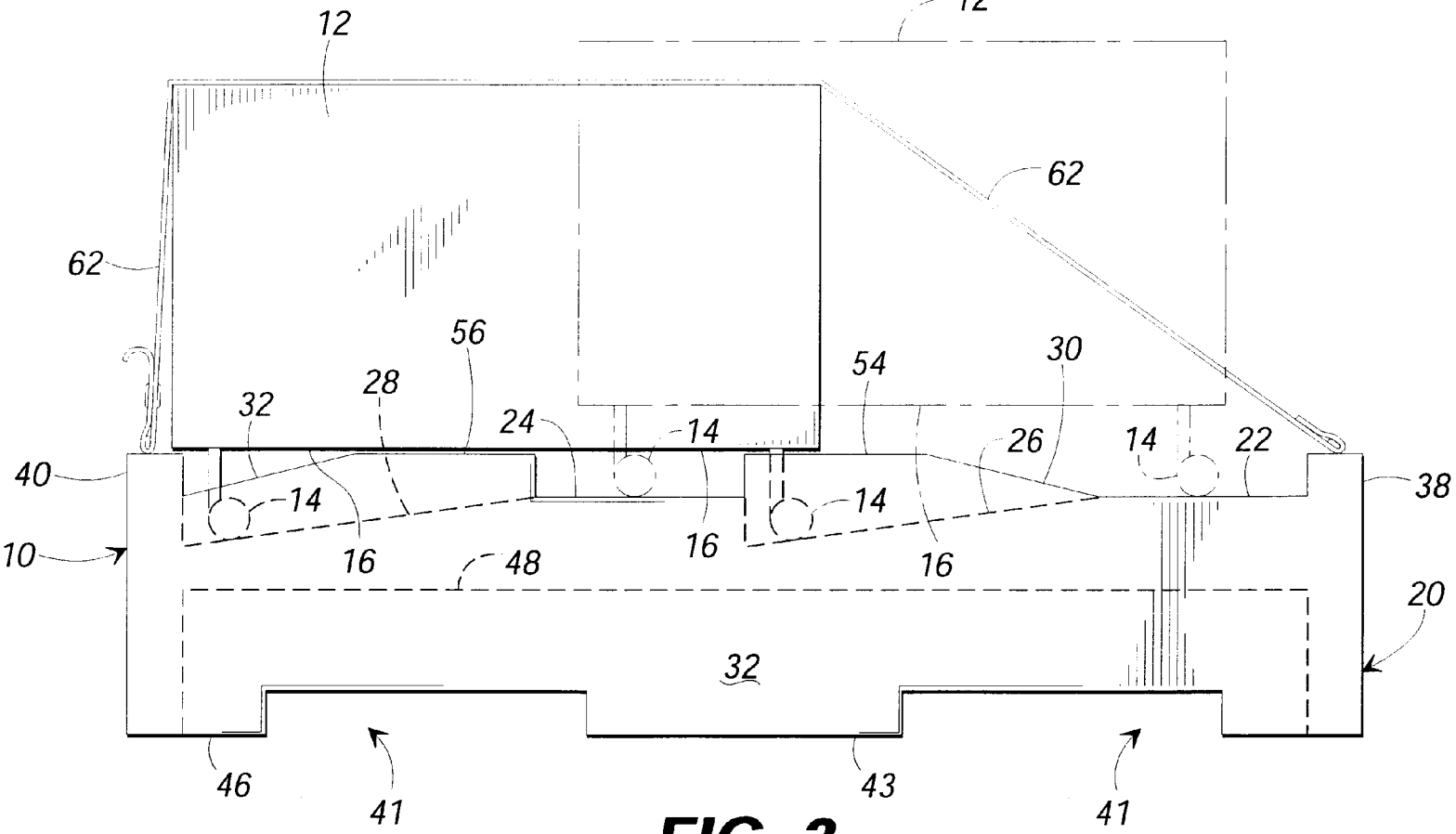
FIG. 3 is an end elevation view of the pallet shown in FIG. 1 illustrating the loading of a wheeled item thereon.

Turning now to the drawings in which like numerals reference like parts throughout the several views, a pallet 10 is shown for storing a wheeled item 12 which includes a set of aligned casters 14 extending beneath an undercarriage 16. The loading of the pallet 10 with the wheeled item is illustrated in FIG. 3.

Generally described, the pallet 10 includes a base frame 20, a pair of tracks 22 and 24 for receiving the casters 14 of the wheeled item 12, a pair of corresponding ramps 26 and 28 extending from respective tracks to the base frame, and two sets of support members 30 and 32 extending from the ramps away from the base frame. The pallet 10 can be made of a variety of materials provided that the pallet can withstand the weight of the item being stored and repeated handling such as with a forklift. Therefore, suitable materials for making the pallet 10 include wood, metal, and polymer resins such as plastic. Polymer resin is particularly desirable for forming the pallet 10 because many polymer resins are strong, durable, lightweight and relatively inexpensive. In addition, many polymer resins can be injection molded. Injection molding is a desirable method of making the pallet 10. A particularly suitable resin is high density polyethylene.

Figure 1:
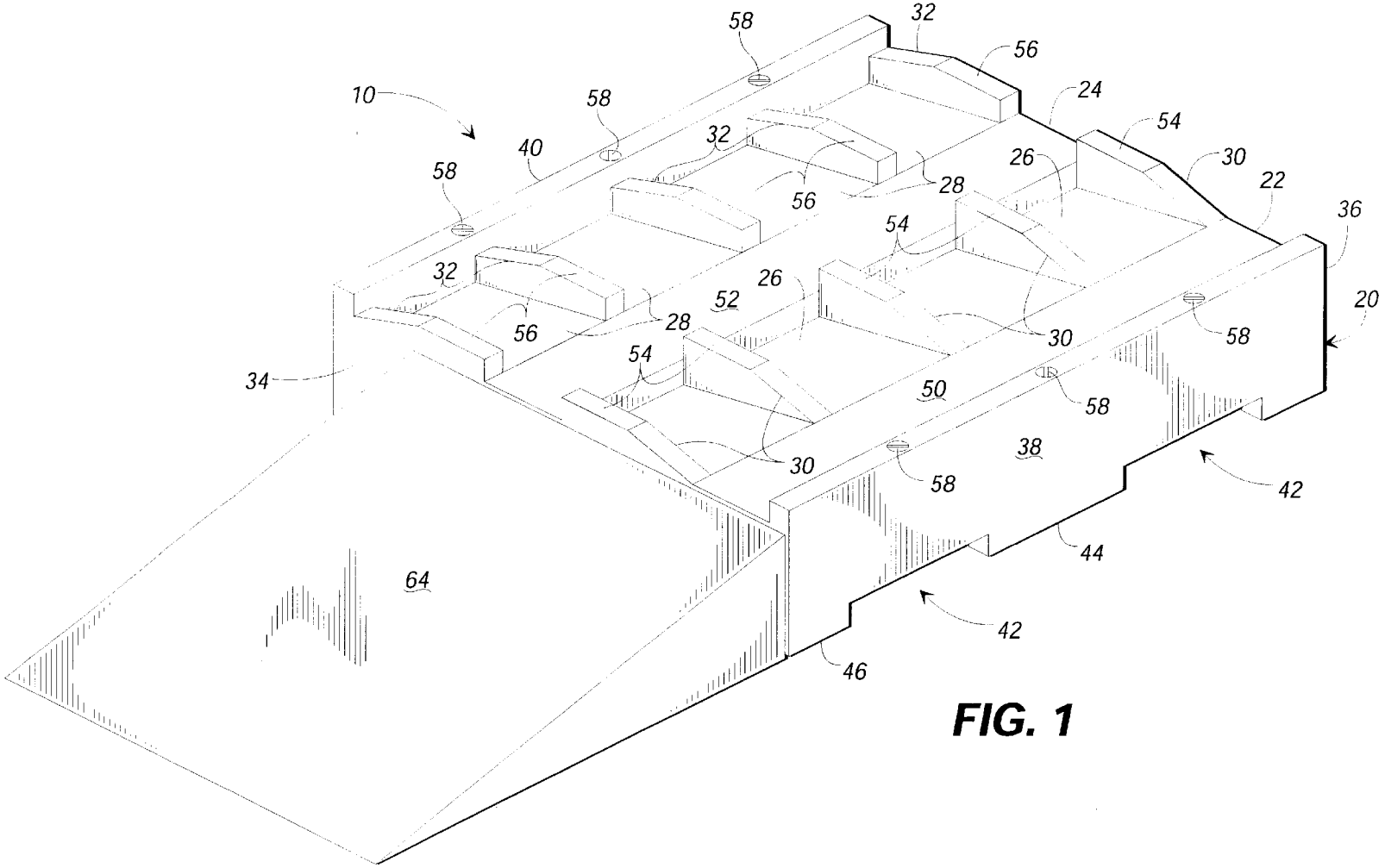
FIG. 1 is a perspective view of a pallet made according to an embodiment of the present invention.
Figure 2:
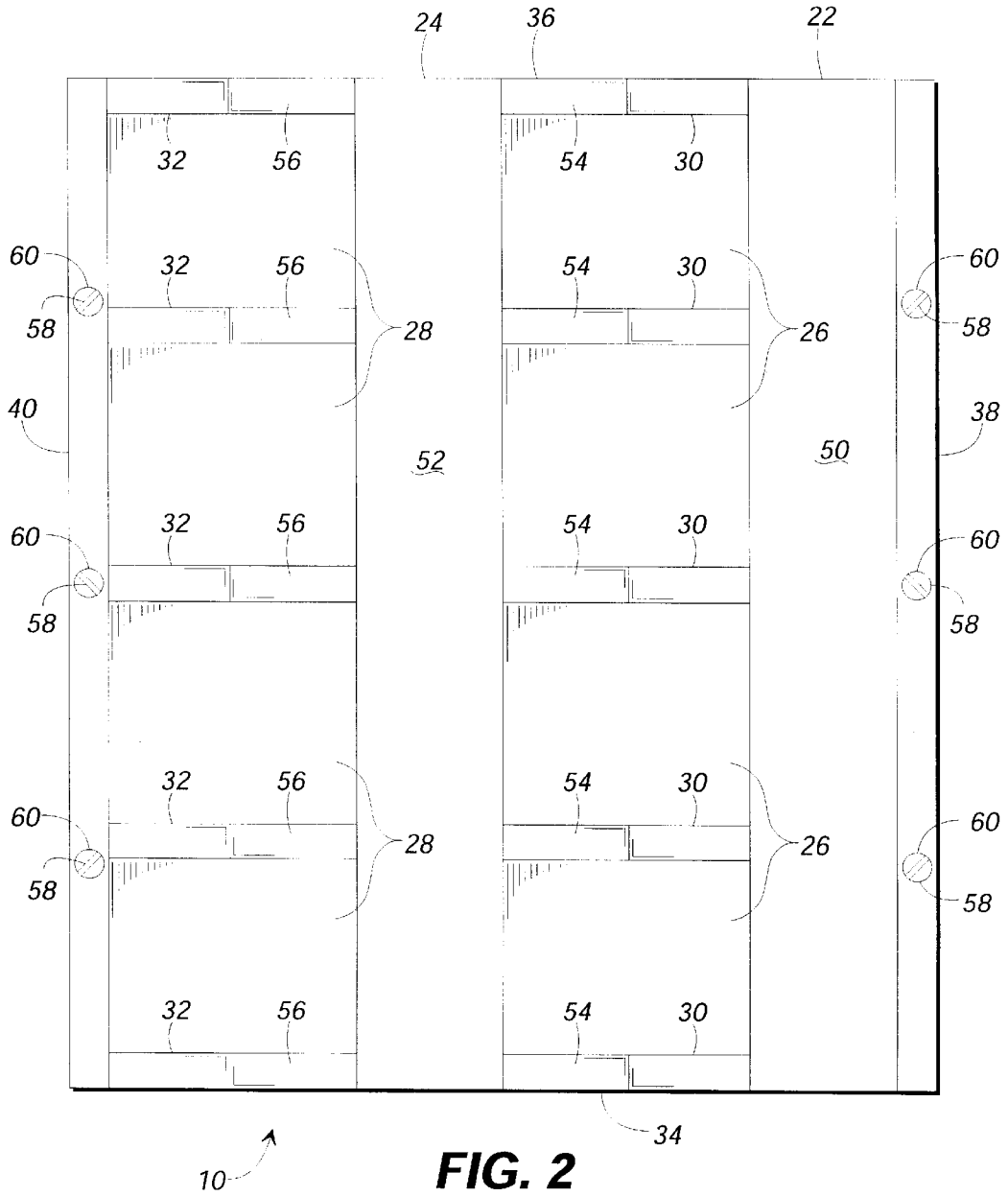
FIG. 2 is a plan view of the pallet illustrated in FIG. 1.

As shown in FIGS. 1 and 2, the base frame 20 of the pallet 10 is substantially rectangular in shape and extends from a first end 34 to a second end 36 along a longitudinal axis and has respective first and second side walls 38 and 40 extending between the first and second ends. In addition, the base frame 20 has a first pair of forklift openings 41 extending from the first end 34 of the base frame to the second end 36 of the base frame and a second pair of forklift openings 42 extending from the first side wall 38 to the second side wall 40 so that the pallet 10 can be manipulated with a forklift from any side of the pallet. The forklift openings 42 are separated by integral middle supports 43 and 44. The forklift openings 41 and 42 and the middle supports 43 and 44 form part of an underside 46 of the base frame 20. The underside 46 of the base frame 20 faces downwardly and rests on the floor when the pallet 10 is being used for loading and storing an item. The base frame 20 extends from the underside 46 upwardly to top side 48 which supports the first and second tracks 22 and 24, the first and second ramps 26 and 28, and the first and second sets of support members 30 and 32.

The first and second tracks 22 and 24 are integrally mounted to the base frame 20 and extend, substantially parallel to and spaced from one another, from the first end 34 to the second end 36 of the base frame. In other words, the first and second tracks 22 and 24 are parallel with the longitudinal axis of the pallet 10. In addition, the first and second tracks 22 and 24 have respective planar surfaces 50 and 52 for receiving the casters 14 of the wheeled item 12 being loaded. The planar surfaces 50 and 52 of the tracks 22 and 24 are substantially horizontal and face upwardly when the pallet 10 is being loaded with or storing a wheeled item.

The first track 22 is positioned adjacent the first side wall 38 of the base frame 20 and the second track 24 is positioned between the first track and the second side wall 40 of the base frame. The first ramp 26 is mounted on the base frame 20 between the first and second tracks 22 and 24 and slopes laterally with respect to the longitudinal axis of the base frame from the first track, downwardly toward the top side 48 of the base frame and toward the second track. The second ramp 28 is mounted to the top side 48 of the base frame 20 such that the second track 24 is between the first ramp 26 and the second ramp. The second ramp 28 slopes laterally with respect to the longitudinal axis of the pallet 10 from the second track 24, downwardly toward the top side 48 of the base frame 20. In other words, the second ramp 28 slopes in the same direction as the first ramp 26.

The set of first support members 30 extend upwardly and away from the first ramp 26 of the pallet 10 beyond the first and second tracks 22 and 24 and are spaced from one another from the first end 34 of the base frame 20 to the second end 36 of the base frame 20. The first support members 30 are parallel to one another and each have an upwardly facing planar support surface 54 for contacting the undercarriage of the wheeled item 12 loaded on the pallet 10. Likewise, the set of second support members 32 extend upwardly and away from the second ramp 28 of the pallet 10 and are spaced from one another from the first end 34 of the base frame to the second end 36 of the base frame. The second support members 32 are parallel to one another and each have an upwardly facing planar support surface 56 for receiving the undercarriage 16 of the wheeled item 12 being stored. The second support members 32 also extend upwardly beyond the first and second tracks 22 and 24. Both the first and second support members 30 and 32 extend perpendicularly between the first and second tracks 22 and 24.

The first and second ramps 26 and 28 slope downwardly relative to the planar support surfaces 54 and 56 of the respective first and second support members 30 and 32, so that when the wheeled item 12 is shifted on its casters 14 laterally with respect to the longitudinal axis of the pallet 10 from the first and second tracks 22 and 24 along the first and second ramps, the undercarriage 16 of the wheeled item comes to rest on the planar support surfaces of the first and second support members and the casters of the wheeled item fall slightly downwardly from the undercarriage of the wheeled item. In other words, when the wheeled item 12 is shifted laterally along the first and second ramps 26 and 28, the weight of the wheeled item comes to rest on the first and second supports 30 and 32 and the weight of the wheeled item shifts substantially from the casters 14 of the wheeled item to the first and second support members 30 and 32 of the pallet 10. This is illustrated in FIG. 3. With the weight of the wheeled item 12 off of the casters 14 and on the pallet 10, the wheeled item can be secured to the pallet.

For securing the wheeled item 12 to the pallet 10, the pallet includes a plurality of pins 58 disposed in recesses 60 in each of the first and second side walls 38 and 40 of the base frame 20. After the wheeled item 12 is loaded onto the pallet and secured on top of the support members 30 and 32, the wheeled item can be secured to the pallet 10 by extending one or more straps over the wheeled item and securing the ends of the straps to the pins 58 in the side walls 38 and 40 of the pallet as illustrated in FIG. 3.

Accordingly, the wheeled item 12 can be easily loaded onto the pallet 10 by positioning the first end 34 of the pallet 10 adjacent a loading ramp 64, rolling the wheeled item 12 up the loading ramp on the casters 14 of the wheeled item while aligning the casters with the first and second tracks 22 and 24 of the pallet, rolling the wheeled item along the first and second tracks until the casters of the wheeled item are between the first and second ends 34 and 36 of the pallet, and then shifting the wheeled item laterally on its casters down the first and second ramps 26 and 28 until the undercarriage 16 of the wheeled item comes to rest on top of the first and second support members 30 and 32. The wheeled item 12 is then secured to the pallet 10 with one or more straps 62 as described above. Once loaded and secured on the pallet 10, the wheeled item can be transported with a forklift.

The pallet 10 can be used to store and transport a variety of wheeled items including but not limited to photocopiers, furniture, safes, televisions, filing cabinets, automated teller machines, main frame computers, computer peripherals, equipment stands, gas grills, and the like. To accommodate the storage and transportation of such items, the pallet 10 can be virtually any size. This invention should not be limited to particular dimensions; however, for most applications, the pallet 10 will have a width from 30 to 80 inches, a length from 30 to 84 inches, a ramp angle from 5 to 40 degrees relative to the horizontal, a ramp length from 5 to 30 inches and support member heights from 2 to 10 inches above the forklift openings. According to a particular embodiment useful for storing and transporting wheeled items having 1 to 3 inch casters which are 16 to 22 inches apart, a width of 34 inches, and a length of 46 inches, the pallet has a width of 4 inches, a length of 48 inches, a track width of 6.5 inches, a ramp angle of 8.6 degrees with respect to the horizontal, and a support member height of 3½ inches from the top side of the base frame.

The pallet 10 enables wheeled items such as photocopy machines to be loaded and secured quickly. A wheeled item can be loaded and secured to the pallet 10 in 30 seconds or less. In addition, the pallet 10 saves space because the pallet allows wheeled items to be stored in multi-level racks. This saves space in storage facilities and in transportation vehicles. Furthermore, the pallet 10 allows wheeled items to be handled more quickly and efficiently because the wheeled items can be manipulated with a forklift after being loaded on the pallet, rather than being wheeled along the floor.

Figure 6:
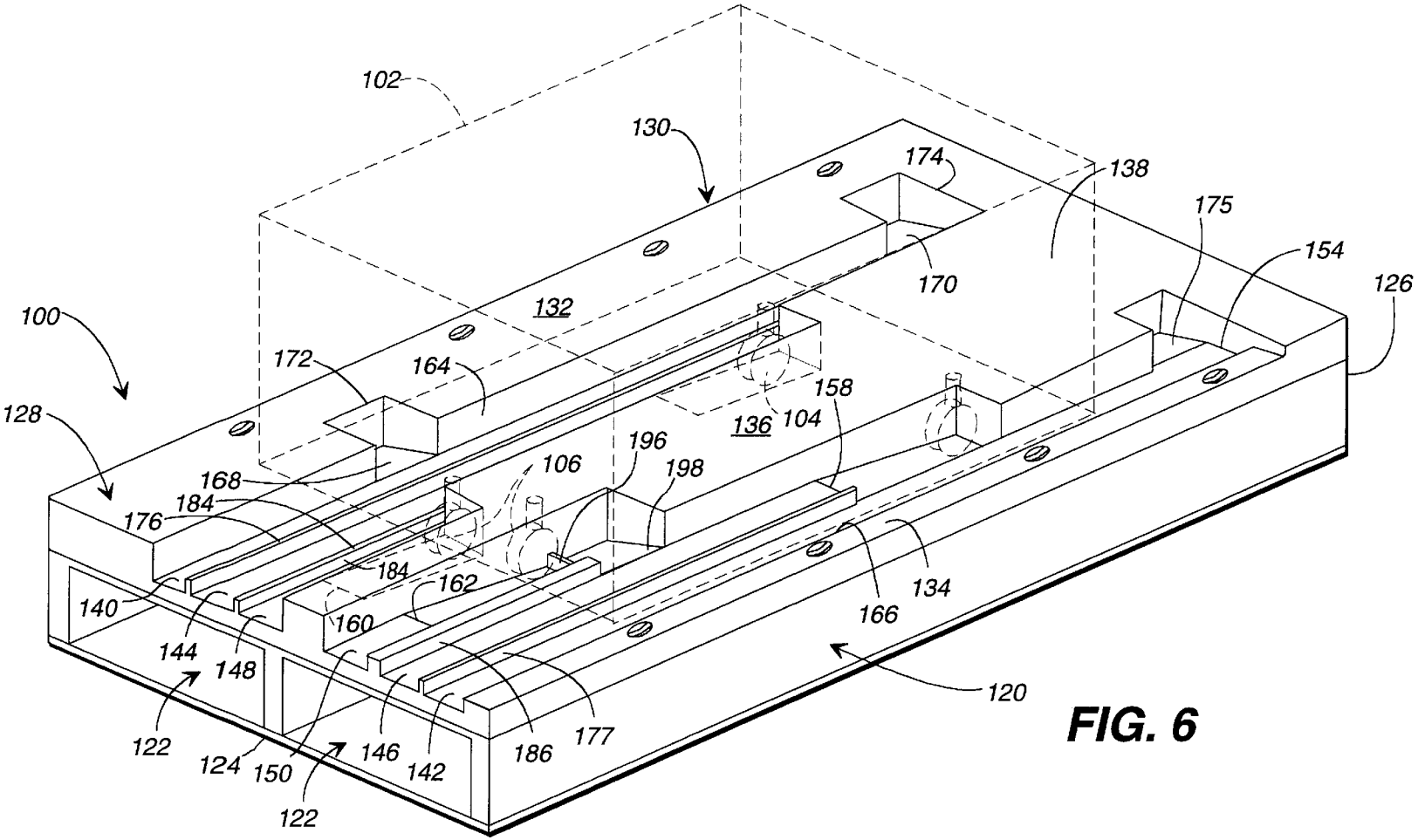
FIG. 6 is a perspective view of the pallet illustrated in FIG. 4 with a wheeled item loaded on the pallet.
Figure 7:
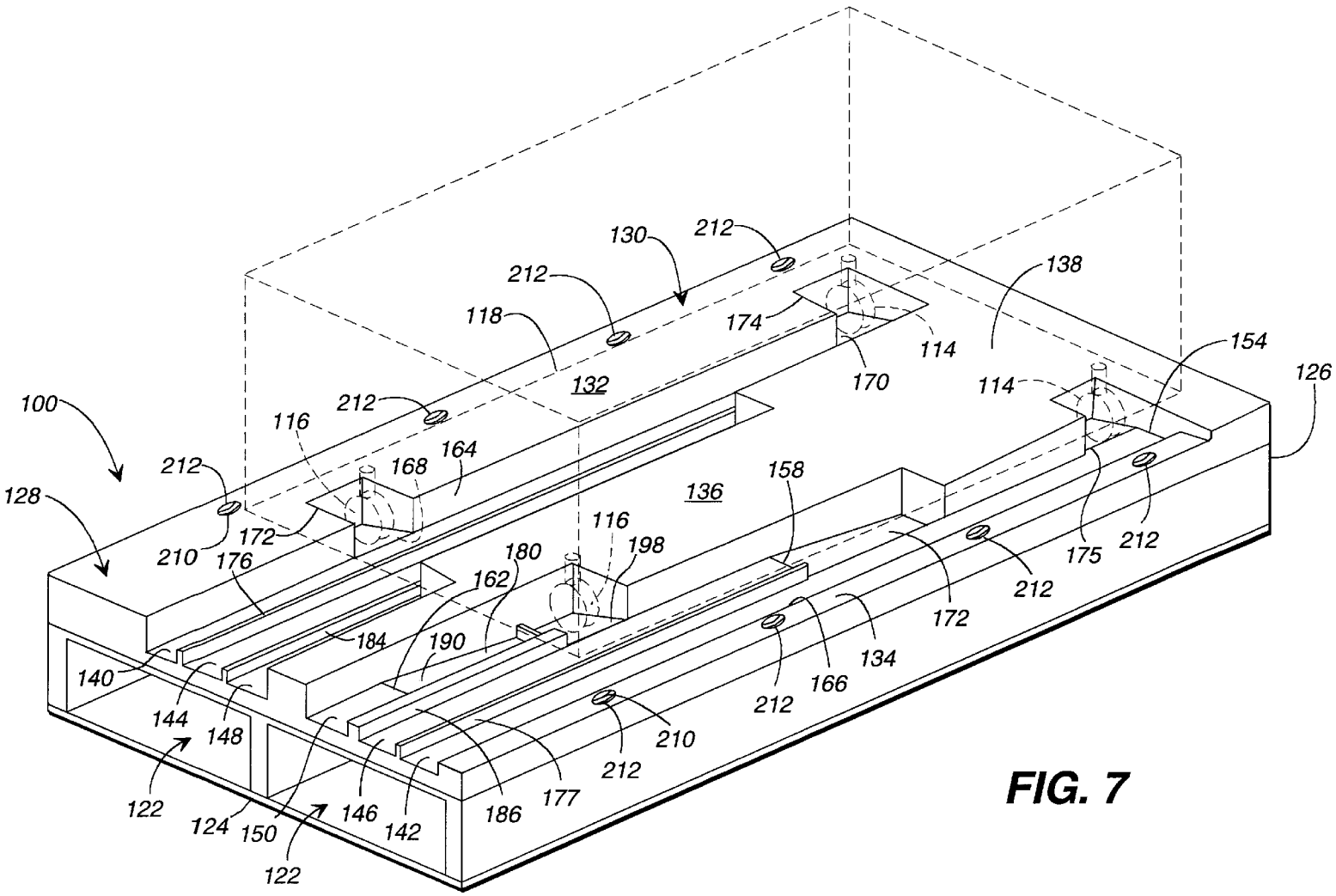
FIG. 7 is a perspective view of the pallet illustrated in FIG. 4 with another wheeled item stored on the pallet.

According to another embodiment of the present invention, a pallet 100 for storing wheeled items with offset casters is illustrated in the FIGS. 4–7. This pallet 100 is suitable for holding two types of wheeled items with offset casters. Loading of pallet 100 with these items is illustrated in FIGS. 6 and 7.

In FIG. 6, the pallet 100 is shown supporting a wheeled item 102 with double offset casters. This wheeled item 102 includes a pair of front casters 104 spaced from one another proximate one end of the wheeled item and a pair of rear caster 106 offset from the front casters proximate another end of the wheeled item. The rear casters 106 are offset inwardly from the front casters 104. The front and rear casters 104 and 106 extend beneath the undercarriage 108 of the wheeled item.

FIG. 7 illustrates the pallet 100 holding a wheeled item 110 with a single offset caster. This wheeled item 110 also has a pair of front casters 114 proximate one end of the wheeled item and a pair of rear casters 116 proximate another end of the wheeled item. One of the rear casters 116 is offset inwardly from the corresponding front caster 114. Again, the front and rear casters 114 and 116 extend downwardly from the undercarriage 118 of the wheeled item 110.

Figure 4:
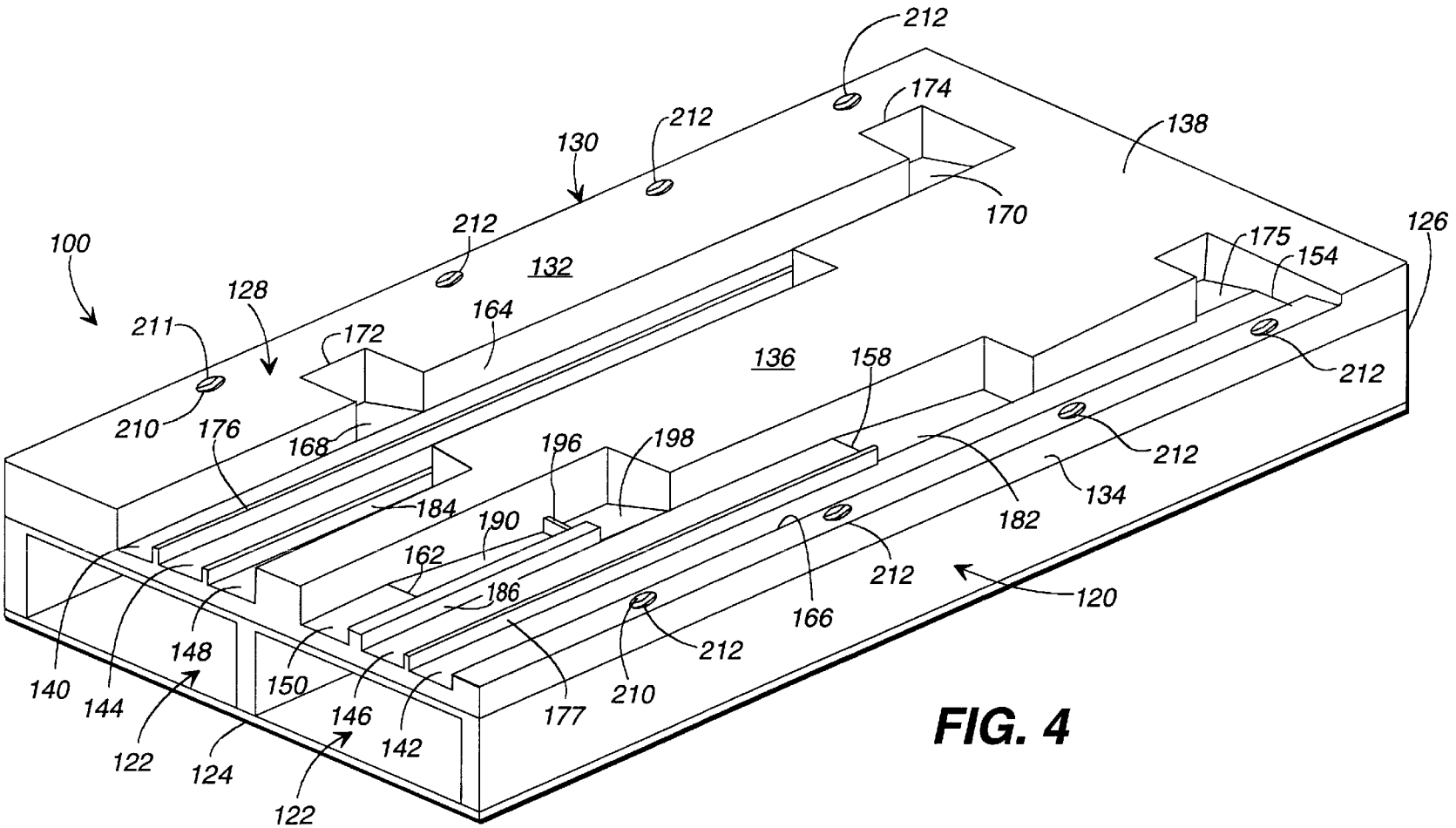
FIG. 4 is a perspective view of a pallet made according to another embodiment of the present invention for use with wheeled items having offset casters.
Figure 5:
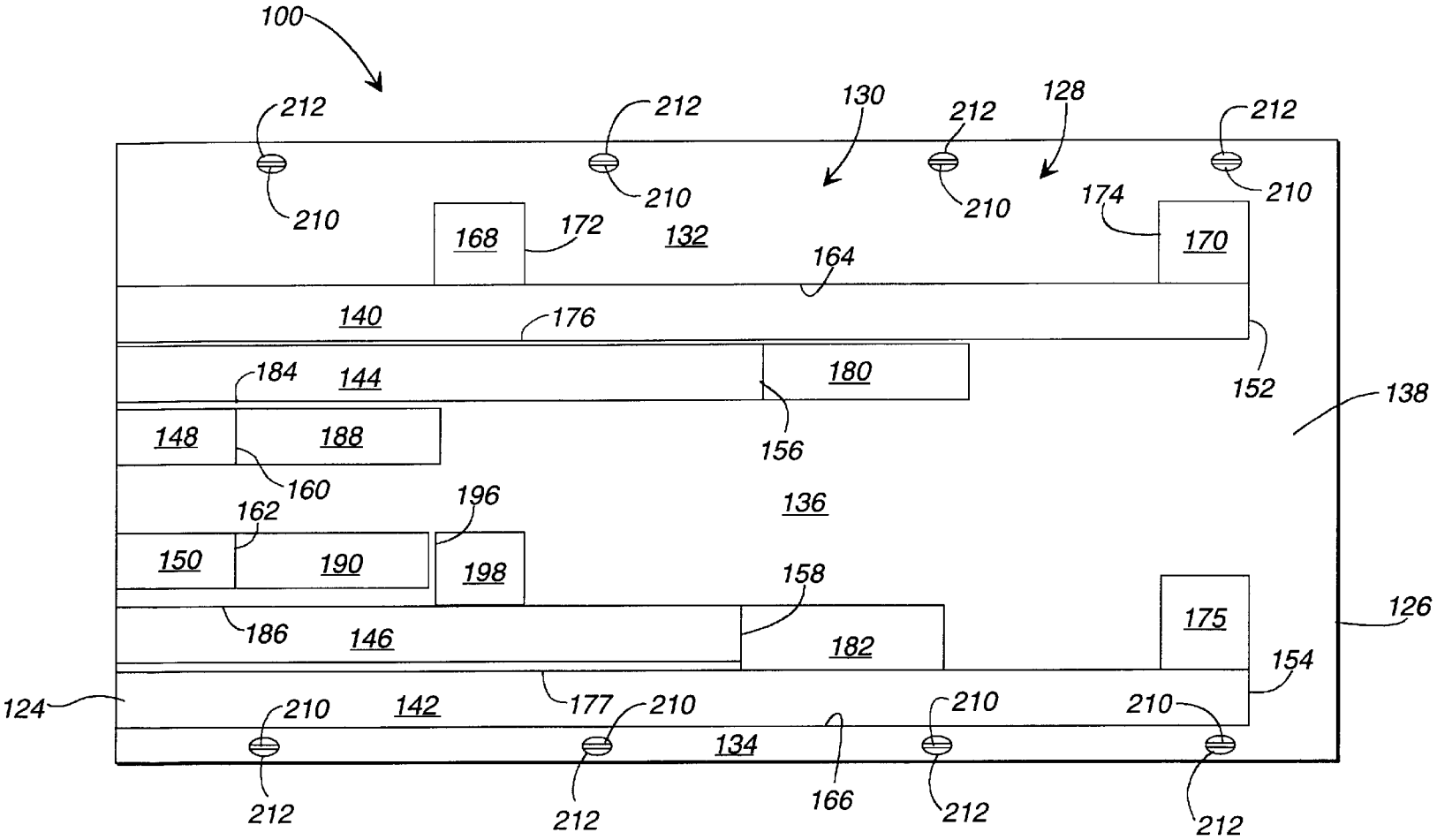
FIG. 5 is a plan view of the pallet illustrated in FIG. 4.

The pallet 100 for wheeled items with offset casters includes a base frame 120, best illustrated in FIG. 4. The base frame 120 has a conventional pallet design that includes fork lift openings 122 extending from a first end 124 to a second end 126. The pallet 100 also includes an upper frame 128 mounted to the base frame for supporting the wheeled items 102 or 110. As with the pallet 10 illustrated in FIGS. 1–3, the pallet 100 for offset wheeled items can be made of a variety of materials provided that the pallet can withstand the weight of the item being stored and repeated handling with a forklift. Again, suitable materials for making the pallet 100 include wood, metal, and polymer resins such as plastic. A particularly suitable resin is high density polyethylene and the pallet 100 is desirably made by plastic molding techniques such as injection molding, rotary molding, or blow molding.

The base frame 120 and the upper frame 128 of the pallet 100 are substantially rectangular in shape and extend from the first end 124 to the second end 126 of the base frame along a longitudinal axis. The upper frame 128 includes an integral raised pallet support 130 for supporting the undercarriage of wheeled items loaded onto the pallet 100. The raise pallet support 130 includes side portions 130 and 134 and a middle portion 136 between the side portions. The raised pallet support 130 forms a planar support surface 138 for contacting the undercarriage of the wheeled items.

Elongate planar tracks 140, 142, 144, 146, 148, and 150 extend parallel to one another from the first end of the base frame 120 toward the second end 126 of the base frame between the side portions 132 and 134 of the raised pallet support 130. Each of the tracks 140, 142, 144, 146, 148, and 150 extend from the first end 124 of the base frame 120 to respective distal ends 152, 154, 156, 158, 160, and 160. The tracks 140, 142, 144, 146, 148, and 150 are arranged in pairs for receiving casters of wheeled items.

Tracks 140 and 142 form a first outer pair of tracks. One of the outer tracks 140 extends adjacent a side wall 164 formed by one side portion 132 of the raised pallet support 130. The other 142 of the outer pair of tracks extends along a side wall 166 formed by the opposite side portion 134 of the raised pallet support 130. A pair of lateral ramps 168 and 170 formed by corresponding recesses 172 and 174 in the side portion 132 of the raised pallet support 130 slope from the first outer track 140 toward the base frame 120 and away from the opposite outer track 142. One of the lateral ramps 168 is positioned toward the first end 124 of the base frame 120 and the other of the lateral ramps 170 is positioned proximate the distal end 152 of the first outer track 140. Another ramp 175 extends laterally from the distal end 154 of the other outer track 142 and slopes laterally and downwardly toward the base frame 120 and the middle portion 136 of the raised pallet support 130.

Elongate dividers 176 and 177 separate the first outer pair of tracks 140 and 142 from the adjacent second pair of tracks 144 and 146. The second pair of tracks 144 and 146 are positioned between the outer tracks 140 and 142 and extend from the first end 124 of the base frame 120 longitudinally toward the second end 126 of the base frame to respective distal ends 156 and 158. Longitudinal here means parallel to the longitudinal axis of the base frame 120. Respective longitudinal ramps 180 and 182 extend from the distal ends 156 and 158 of the second pair of tracks 144 and 146 longitudinally toward the second end 126 of the base frame 120. These longitudinal ramps 180 and 182 slope downwardly from the second pair of tracks 144 and 146 toward the base frame 120. The longitudinal ramps 180 and 182 extend from the second pair of tracks 144 and 146 stop well short of the distal ends 152 and 154 of the adjacent outer tracks 140 and 142 and are disposed between the respective outer tracks and the middle portion 136 of the raised pallet support 130.

The third and innermost pair of tracks 148 and 150 extend longitudinally adjacent respective ones of the second pair of tracks 146 and 148. The middle portion 136 of the raised pallet support 130 separates the third pair of tracks 148 and 150 and dividers 184 and 186 separate the third pair of tracks from the second pair of tracks. The third pair of tracks 148 and 150 are much shorter than the second pair of tracks 144 and 146. Longitudinal ramps 188 and 190 extend from the respective distal ends 160 and 162 of the third pair of tracks 148 and 150 and slope downwardly from the third pair of tracks toward the base frame 120. The longitudinal ramps 188 and 190 also stop well short of the distal ends 156 and 158 of the second pair of tracks 144 and 146.

A lateral divider 196 separates the longitudinal ramp 190 of one of the innermost tracks 150 from a ramp 198 sloping laterally from the adjacent track 146 downwardly toward the base frame 120 and toward the middle portion 136 of the raised pallet support 130.

FIG. 6 illustrates the wheeled item 102 having double offset casters 106 mounted on the pallet 100. The wheeled item 102 is shown in phantom lines. To load the wheeled item 102, the wheeled item is loaded onto the pallet 100 by means such as a ramp or forklift so that the outwardly positioned front casters 104 travel along the outwardly positioned first pair of tracks 140 and 142 and the inwardly offset rear casters 106 travel along second pair of tracks 144 and 146. The wheeled item 102 is pushed on the casters 104 and 106 along the ramps 144, 146, 148, and 150 and then down the longitudinal ramps 180, 182, 188, and 190 until the undercarriage 108 of the wheeled item rests firmly on the planar support surface 138 of the raised pallet support 130. The wheeled item 102 can then be secured to the pallet 100 with straps attached to pins 210 mounted in recesses 212 along with side portions 132 and 134 of the raised pallet support 130.

It should be understood that although the ramps 180, 182, 188, and 190 are illustrated as longitudinal, such ramps can be diagonally directed or otherwise laterally directed provided that the ramps do not intersect any of the adjacent ramps and interfere with the casters traveling down the tracks. Furthermore, the longitudinal ramps 180, 182, 188, and 190 desirably slope so that the weight of the wheeled item 102 shifts from the casters to the raised pallet support 130 and the casters fall slightly downwardly from the undercarriage 108.

FIG. 7 illustrates how the pallet 100 can also accommodate the wheeled item 110 with the single offset rear caster 116. In this mode, the front casters 114 of the wheeled item 110 travel along the outermost pair of tracks 140 and 142, one of the rear casters 116 travels along one of the outer tracks 140, and the slightly inset one of the rear casters 116 travels along one of the second pair of tracks 146. The front and rear casters 114 and 116 are then shifted laterally along the lateral ramps 168, 170, 175, and 190 until the undercarriage 118 of the wheeled item 110 rests on the planar support surface 138 of the raised pallet support 130. Again, the lateral ramps 168, 170, 175, and 190 are sloped to a degree such that the weight of the wheeled item 110 shifts from the casters to the raised pallet support 130 and the casters fall slightly away from the wheeled item 130. As with the other wheeled items, this wheeled item 110 can be secured to the pallet 100 with straps, or the like.

It should be understood that the foregoing relates to particular embodiments of the present invention, and that numerous changes may be made therein without departing from the scope of the invention as defined by the following claims.

I claim:

1. A pallet for a wheeled item comprising an undercarriage and wheels extending from the undercarriage, the pallet comprising:

a base frame having openings for receiving fork lift arms and a longitudinal axis extending from a first end to a second end;

a plurality of tracks mounted on the base frame for receiving the wheels of the item, the tracks extending from the first end toward the second end substantially parallel to and spaced from one another; and a plurality of ramps mounted on the base frame and sloping from the plurality of tracks toward the base frame;

the plurality of tracks and the plurality of ramps structured and arranged so that when the wheeled item is shifted on the wheels from the plurality of tracks along the plurality of ramps, the undercarriage of the wheeled item comes to rest on a support surface of the pallet.

2. A pallet as in claim 1 wherein each of the plurality of tracks extends from the one end of the base frame to a distal end and the plurality of ramps extend from respective distal ends of the plurality of tracks without interrupting an adjacent one of the plurality of tracks.

3. A pallet as in claim 2 wherein the plurality of ramps extend longitudinally from respective distal ends of the plurality of tracks.

4. A pallet as in claim 2 wherein the plurality of ramps extend diagonally from respective distal ends of the plurality of tracks.

5. A pallet as in claim 1 wherein the plurality of ramps extend laterally from respective ones of the plurality of tracks.

6. A pallet as in claim 1 for a wheeled item having offset wheels wherein the plurality of tracks includes a first pair of tracks and a second pair of tracks spaced inwardly from the first set of tracks and wherein each of the first and second pairs of tracks extends from the one end of the base frame to a distal end and the plurality of ramps extend from respective distal ends of the first and second pairs of tracks without interrupting an adjacent one of the first and second pairs of tracks.

7. A pallet as in claim 6 wherein the plurality of ramps extend longitudinally from respective distal ends of the plurality of tracks.

8. A pallet as in claim 6 wherein the plurality of ramps extend diagonally from respective distal ends of the plurality of tracks.

9. A pallet as in claim 1 further comprising a support adjacent the plurality of tracks extending from the pallet in a direction away from the base frame so that when the wheeled item is shifted on the wheels from the plurality of tracks along the plurality of ramps, the undercarriage of the wheeled item comes to rest on the support.

10. A pallet as in claim 9 wherein the support extends away from the base frame beyond the plurality of tracks.

11. A pallet as in claim 9 wherein the wheeled item has a weight and the plurality of ramps are sloped toward the base frame relative to the support such that at least a portion of the weight is shifted from the wheels of the item to the support when the wheeled item is shifted on the wheels from the plurality of tracks along the plurality of ramps so that the undercarriage of the wheeled item comes to rest on the support.

12. A pallet as in claim 1 further comprising first and second side walls extending between the first and second ends of the base frame along respective opposite sides of the base frame for preventing the wheeled item from rolling laterally off of the pallet.

13. A pallet as in claim 12 further comprising a plurality of pins mounted to the pallet for securing, a strap for holding the wheeled item onto the pallet.

14. A pallet as in claim 1 wherein the pallet is made of polymer resin.

15. A pallet as in claim 1 wherein the pallet is made of injection-molded polymer resin.

16. A pallet as in claim 14 wherein the polymer resin is high-density polyethylene.

17. A pallet for a wheeled item comprising an undercarriage and wheels extending from the undercarriage, the pallet comprising:

a base frame having openings for receiving fork lift arms and a longitudinal axis extending from a first end to a second end;

a support mounted on the base frame and having a support surface for receiving the wheels of the item; and a plurality of ramps mounted on the base frame and sloping from proximate the support surface toward the base frame through recesses in the support;

the support and the plurality of ramps structured and arranged so that when the wheeled item is shifted on the wheels from the support surface along the plurality of ramps, the undercarriage of the wheeled item comes to rest on the support surface.

18. A pallet for a wheeled item comprising an undercarriage and wheels extending from the undercarriage, the pallet comprising:

a base frame having openings for receiving fork lift arms and a longitudinal axis extending from a first end to a second end;

first and second tracks mounted on the base frame for receiving the wheels of the item, the first and second tracks extending from the first end toward the second end substantially parallel to and spaced from one another;

at least one first ramp mounted on the base frame and sloping from the first track toward the base frame; and at least one second ramp mounted on the base frame and sloping from the second track toward the base frame, the first and second tracks and at least one first and at least one second ramps structured and arranged so that when the wheeled item is shifted on the wheels from the first and second tracks along the at least one first and at least one second ramps, the undercarriage of the wheeled item comes to rest on a support surface of the pallet.

19. A pallet as in claim 18 further comprising a support adjacent the first and second tracks extending from the pallet in a direction away from the base frame so that when the wheeled item is shifted on the wheels from the first and second tracks along the at least one first and at least one second ramps, the undercarriage of the wheeled item comes to rest on the support.

20. A pallet as in claim 19 wherein the wheeled item has a weight and the at least one first and at least one second ramps are sloped toward the base frame relative to the first and second supports such that at least a portion of the weight is shifted from the wheels of the item to the support when the wheeled item is shifted on the wheels from the first and second tracks along the at least one first and at least one second ramps so that the undercarriage of the wheeled item comes to rest on the support.

21. A pallet as in claim 18 wherein the pallet is made of polymer resin.

22. A pallet as in claim 21 wherein the polymer resin is high-density polyethylene.

23. A pallet for a wheeled item comprising an undercarriage and wheels extending from the undercarriage, the pallet comprising:

a base frame having openings for receiving fork lift arms and a longitudinal axis extending from a first end to a second end;

a support on the base frame and having a support surface for receiving the wheels of the item; and a plurality of ramps on the base frame and sloping from the support toward the base frame;

the support and the plurality of ramps structured and arranged so that when the wheeled item is shifted on the wheels from the support surface along the plurality of ramps, the undercarriage of the wheeled item comes to rest on the support surface.

* * * * *